United States Patent [19]

Asberg

[11] Patent Number: 4,782,761

[45] Date of Patent: Nov. 8, 1988

[54] CABLE TENSIONING DEVICE FOR SKI LIFTS OR AERIAL CABLEWAYS

[75] Inventor: Bengt Asberg, Stockholm, Sweden

[73] Assignee: Liftbyggarna AB, Ostersund, Sweden

[21] Appl. No.: 45,857

[22] PCT Filed: Jul. 16, 1986

[86] PCT No.: PCT/SE86/00338

§ 371 Date: Apr. 3, 1987

§ 102(e) Date: Apr. 3, 1987

[87] PCT Pub. No.: WO87/01080

PCT Pub. Date: Feb. 26, 1987

[30] Foreign Application Priority Data

Aug. 15, 1985 [SE] Sweden ..... 8503818

[51] Int. Cl.[4] ..... B61B 12/06

[52] U.S. Cl. ..... 104/196; 74/89.15; 74/424.8 R; 104/173.1

[58] Field of Search ..... 104/117, 173.1, 173.2, 104/178, 196; 74/89.15, 424.8 R

[56] References Cited

U.S. PATENT DOCUMENTS

| | | | |
|---|---|---|---|
| 2,285,636 | 6/1942 | Wallace | 104/173.2 |
| 2,677,331 | 5/1954 | Hauseman | 104/196 |
| 2,820,420 | 1/1958 | Hayes | 104/196 |
| 3,052,470 | 9/1962 | Pomagalski | 104/196 |
| 3,129,605 | 4/1964 | Bonnell, Jr. et al. | 104/196 |
| 3,377,959 | 4/1968 | Hawes | 104/173.1 |
| 3,861,514 | 1/1975 | Ling | 104/173.2 |
| 3,951,073 | 4/1976 | Sowder | 104/196 |
| 4,003,314 | 1/1977 | Pearson | 104/178 |
| 4,402,272 | 9/1983 | Habegger | 104/196 |
| 4,416,313 | 11/1983 | Seeger | 74/89.15 |
| 4,470,355 | 9/1984 | Kunczynski | 104/196 |

FOREIGN PATENT DOCUMENTS

| | | |
|---|---|---|
| 2424062 | 11/1975 | Fed. Rep. of Germany . |
| 02524 | 8/1982 | PCT Int'l Appl. . |

*Primary Examiner*—George L. Walton

*Attorney, Agent, or Firm*—McFadden, Fincham & Co.

[57] ABSTRACT

The invention relates to a cable tensioning device for ski lifts or aerial cableways of the kind comprising an endless transporting cable (1) extending between two rotatable wheels (2) mounted on carriers (4), at least one of the wheels being movable by the fact that its associated carrier is slideably movable relative to a foundation in order to keep the cable tensioned. The carrier (4) is by means of a nut device connected to a suitably rotatable screw (13). A tension sensing device is associated to a power source (19) for causing a rotating relative movement between the screw (13) and the nut device in order to, at an occurred change in the tension of the cable (1), start the power source (15) and effect a movement of the wheel (2) in question a distance relative to the foundation that corresponds to the actual tensional change.

3 Claims, 3 Drawing Sheets

CABLE TENSIONING DEVICE FOR SKI LIFTS OR AERIAL CABLEWAYS

TECHNICAL FIELD OF THE INVENTION

This invention relates to a cable tensioning device for ski lifts or aerial cableways of the kind comprising an endless transporting cable extending between two rotatable wheels mounted on posts or carriers, at least one of the wheels being movable by the fact that its associated carrier is slideably movable backwards and forwards in relation to a fixed, elongated foundation in order to continuously keep the cable properly tensioned.

STATE OF THE ART

It is preferred to drive the transport cable, in constructions of the above described kind, by means of the wheel being included in the bottom station of the construction, whereas the wheel being included in the mountain station is arranged to idle (although also per se the opposite arrangement is conceivable). It is not rare that the distance between the bottom station and the mountain station is very large and it may amount to 700–1000 m or more. A transport cable of this length is in practice subject to very large variations in length, partly in the form of a continuously progressing lengthening caused by compression and stretching thereof, partly in the form of temporary shortenings and lengthenings respectively due to temporary variations in temperature. To compensate these variations in length and to keep the cable properly tensioned, some kind of cable tensioning device has to be used that continuously moves one of the two cable wheels to positions wherein the cable is not slack.

Previously known cable tensioning devices for this purpose have comprised either counter-weight or hydraulic cylinder piston arrangements. A great drawback in the last-mentioned are however that the stroke of the pistons included in the hydraulic cylinders in question is too small to cover the distance of movement of the movable wheel without lengthy re-connections of a number of distance pieces. In counter-weight arrangements the position of the counterweight must be roughly adjusted at recurrent occasions since the counterweight has a space for heightwise movement that is smaller than the distance of movement that is necessary for the movable cable wheel.

SHORT DESCRIPTION OF THE INVENTIVE CONCEPT

The present invention aims to remove the above drawbacks in the previously known cable tensioning devices and to create a cheap, simple cable tensioning device that can cover the entire necessary distance of movement of the cable wheel in question also at very large cable lengths. This is obtained, in accordance with the characteristics of the invention, therein that the wheel carrier in question by means of at least one nut device is connected to a suitably rotatable screw and that a tension sensing device is associated to a power source for causing a rotating relative movement between the screw and the nut device in order to, when a change in tension occurs, actuate the power source and to effect said relative movement between the screw and the nut device and in this way move the carrier with its associated wheel a distance along the foundation corresponding to the actual tensional change.

SHORT DESCRIPTION OF THE ATTACHED DRAWINGS

In the drawings

FIG. 1 is a simplified perspective view illustrating a valley or bottom station and a cable tensioning device according to the invention included therein, FIG. 2 is a partly sectioned side view showing a carriage included in the device FIG. 3 a plan view of the device, and FIG. 4 an enlarged detail in the device according to the invention.

DETAILED DESCRIPTION OF A PREFERRED EMBODIMENT OF THE INVENTION

Figure 1:
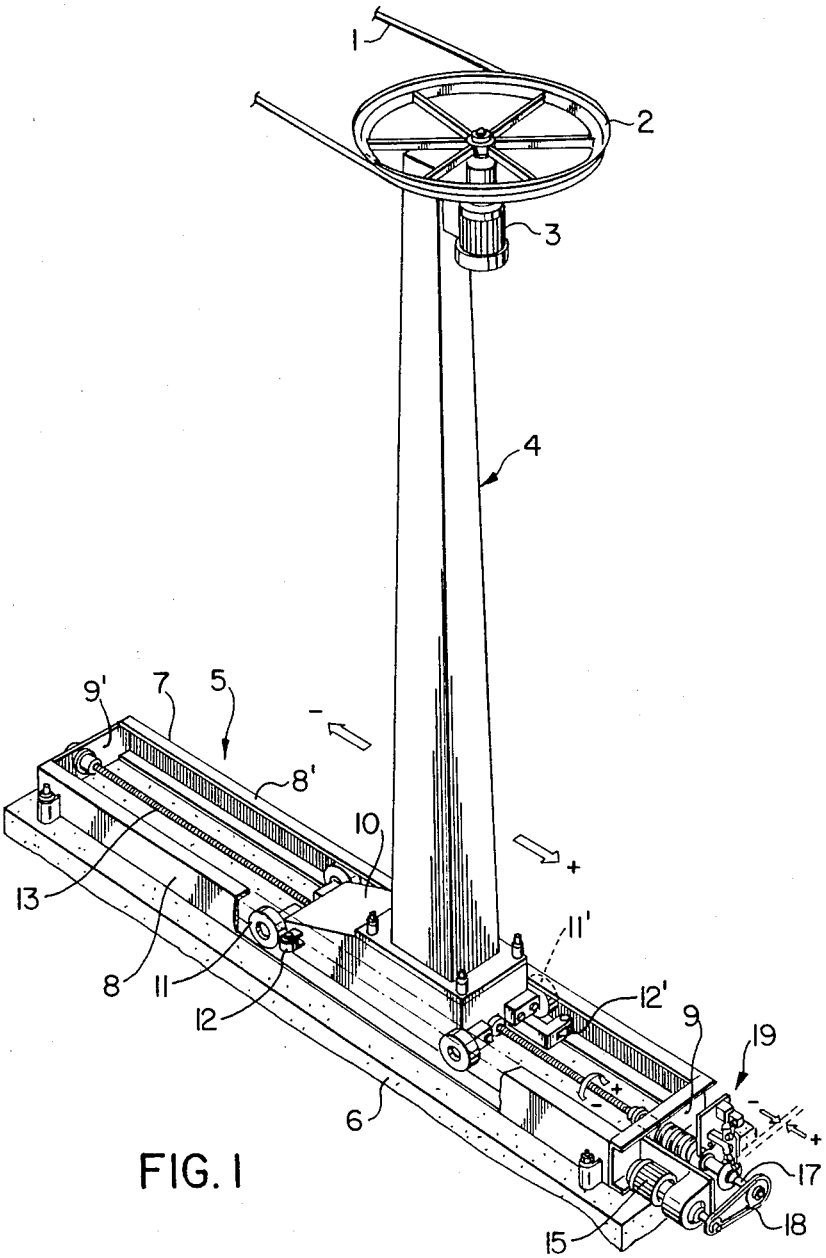
Figure 2:
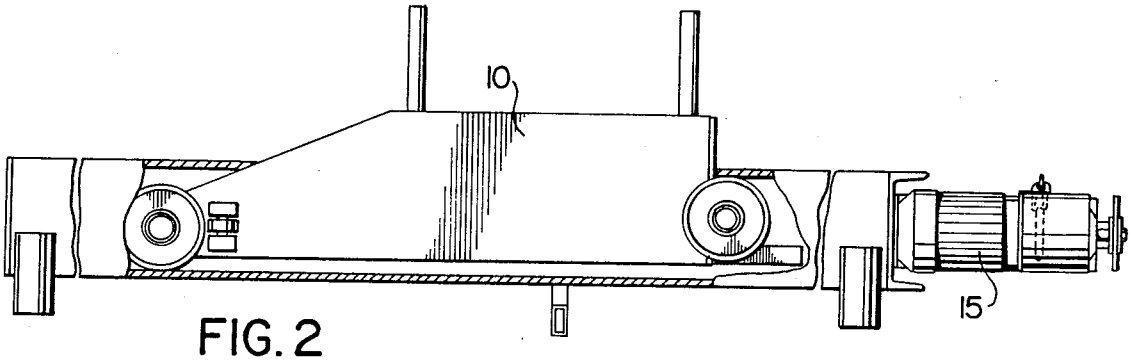

In FIG. 1 1 denotes an endless transport cable being laid around two rotatable wheels 2 of which one, included in a bottom station, is shown in FIG. 1, whereas the other, included in a mountain station, is not shown in the drawings. Of these two wheels the one shown in FIG. 1 can be driven by means of a power source 3, for instance an electric motor and a gear. The wheel 2 is mounted on a carrier denoted in its entirety with 4, in the example shown consisting of a post on whose upper end the wheel 2 is located. 5 designates generally an elongated foundation including on one hand a concrete slab 6 anchored in the ground and on the other hand a guide construction 7 anchored in the concrete slab and being composed by two elongated U-beams 8,8' mutually connected by end pieces 9,9'. The U-beams 8,8' form guides for a wheel-carried carriage 10 whereon the post 4 is mounted. More specifically, the carriage 10 includes two pairs of wheels 11,11', that suitably are maximally separated, and two diametrically opposed supporting wheels 12,12' that are intended to take the torque that is transmitted to the carrier from the driving wheel 2 through the post 4. In practice the length of the foundation can amount to 7 to 15 meters, while the length of the carriage 10 amounts to 1.5 to 3 meters.

Figure 3:
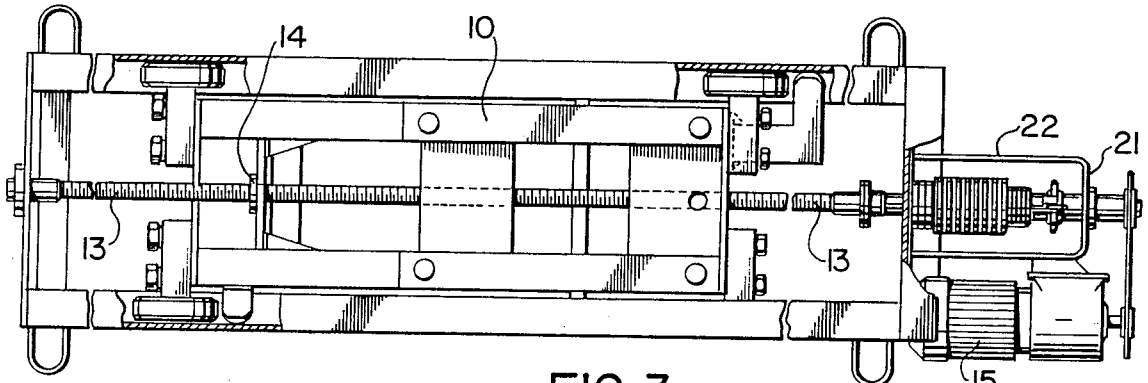

Between the two end pieces 9,9' a screw 13, in the example shown being rotatable, is arranged to co-operate with a nut 14 fixedly attached to the frame of the carriage 10 as can be seen in FIG. 3. A power source is arranged for the driving of the screw 13, in the example shown consisting of an electrically driven cog gear motor 15 whose output shaft is connected to an extension 17 of the screw 13 by means of a transmission 18, suitably in the form of a chain transmission.

Figure 4:
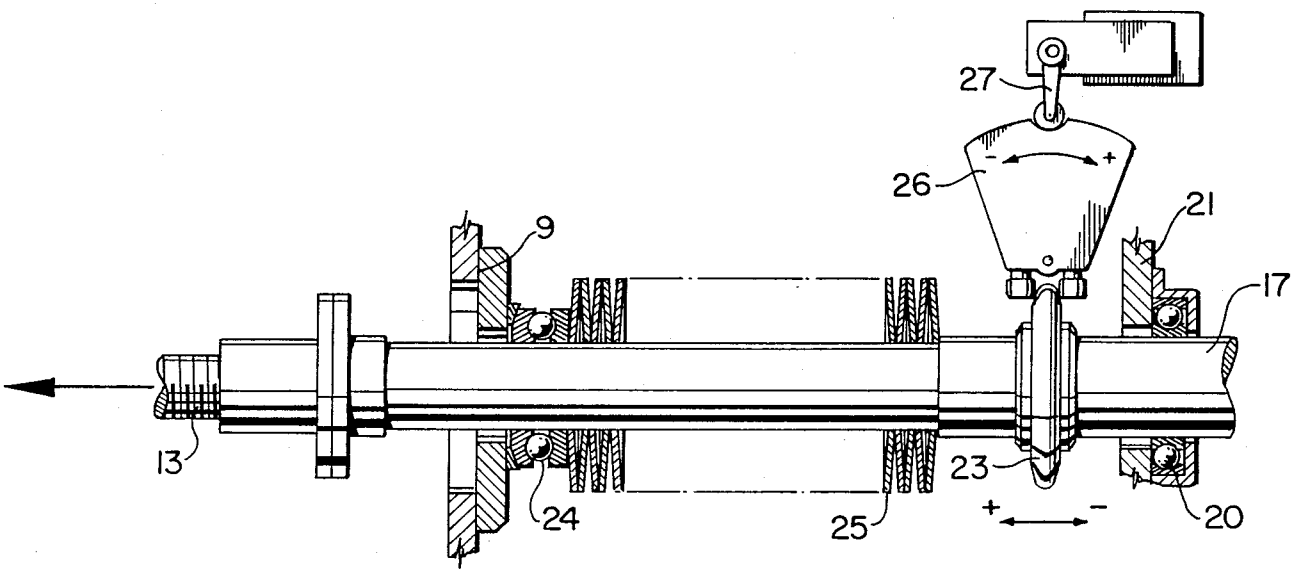

19 generally denotes a device having the purpose to sense the current cable tension and to control the operation of the motor 15. The details of this sensing device 19 can be seen more closely in FIG. 4 to which reference is now made.

The extension 17 of the screw 13 is formed as a shaft and is journalled in a radial bearing 20 attached to an end wall 21 included in an U-shaped bracket 22 attached to the end piece 9 (see also FIG. 3). A cam disc 23 is attached to the extension shaft and a spring assembly 25 is arranged between this disc and an axial bearing 24 arranged on the end piece 9. The disc 23 is arranged to co-operate with a breaker disc 26, rockable forwards as well as backwards and being in turn in engagement with a breaker 27 having the purpose to actuate the motor 15 in one of two opposite rotational directions in dependence of the direction of movement of the breaker disc.

The spring assembly 25 will be compressed to a certain length due to the tensile stress which the screw 13 is subjected to by the load from the cable 1 and which is proportional to the cable tension. In other words a certain cable tension corresponds to a certain length of the spring assembly and thus to a certain distance between the end piece 9 and the disc 23.

The Function and Advantages of the Device According to the Invention

At a given cable tension the carriage 10 is positioned relative to the foundation 5 in a way that the wheel 2 keeps the cable 1 properly tensioned. If then the length of the cable tends to increase, the change in tension in the cable is sensed by means of the device 19 which starts the motor 15 thus bringing the screw 13 into rotation. This rotation of the screw results in that the carriage is set into motion by the co-operation of the screw with the fixed nut device 14 on the carriage 10, more specifically to the right in FIG. 1 and a distance that corresponds to the actual change in tension. This increase in length and decrease in tension of the cable 1 will be compensated by this movement of the wheel 2 and thus the cable will be tensioned to the required extent.

Should on the other hand the cable 1 tend to be shortened due to a temporary decrease in temperature, screw 13 is brought to rotate in the opposite direction to the one described above, whereby the post 4 and the wheel 2 are brought to move towards the left in FIG. 1 at each regulating occasion decided by the device 19.

In practice the carriage 10 will of course move extremely short distances at the separate regulating occasions.

The described device can in a simple and rational way automatically take care of the necessary cable tension since the described screw can be given a length exceeding the maximum occurring variations in length of the cable 1 at the same time as the carriage in question is continuously movable along the entire length of the screw, there being no need of manual reconnections or adjustments of the kind needed in conventional counterweight or hydraulic cylinder arrangements.

Possible Modifications of the Invention

It is evident that the invention is not limited only to the embodiment described and shown in the drawings. Thus it is for instance possible to arrange the screw to be fixed in relation to the foundation whilst the nut device is designed to be rotatable and drivable by means of a motor accompanying the carriage, instead of having a rotatable screw and a nut fixed on the carriage or carrier in question. The carrier in question does furthermore not have to be in the form of a post or pillar. Thus the foundation or guide construction in question can be arranged on the upper part of a pillar construction firmly anchored in the ground, the carrier being in the form of a carriage or sled being movable relative to the guide construction and on which the wheel 2 is directly mounted. It should also be pointed out that the movable, tension compensating wheel not necessarily must be the driven wheel. Alternatively the idling wheel thus can be slideably movable in the described manner. Finally it should be pointed out that any optional tension sensing devices can be used for the controlling of the power source for the rotation of the screw or the nut device. In practice thus strain gauges, per se being known and being of the kind that work with changes in resistance by stretching, can advantageously be used for this purpose.

I claim:

1. Cable tensioning device for ski lifts or aerial cableways of the kind comprising an endless transporting cable extending between two rotatable wheels mounted on posts or carriers, at least one of the wheels being movable by the fact that its associated carrier is slideably movable backwards and forwards in relation to a fixed, elongated foundation in order to keep the cable properly tensioned independently of variations of length in said cable characterized in that said carrier by means of at least one nut device is connected to a screw and that a tension sensing device is associated to a power source for causing a rotating relative movement between the screw and the nut device in order to, when a change in tension occurs, actuate the power source and to effect said relative movement between the screw and the nut device and in this way move the carrier with its associated wheel a distance along the foundation corresponding to the actual tensional change.

2. Cable tensioning device according to claim 1, characterized in that the carrier includes a carriage with wheels that are in engagement with and movable along guides e.g. U-beams, being included in said foundation.

3. Cable tensioning device according to claim 1 or 2, wherein said screw is rotatable.

* * * * *